US012161207B2

(12) United States Patent
Williams et al.

(10) Patent No.: US 12,161,207 B2
(45) Date of Patent: Dec. 10, 2024

(54) STACK AND LOCK SYSTEM FOR STORAGE PRODUCT AND STORAGE CONTAINER

(71) Applicant: GROWN-UP LICENSES LIMITED, Tai Po (HK)

(72) Inventors: Matthew Williams, Lighthouse Point, FL (US); Ricky LAM Hon Hung, Kowloon (HK)

(73) Assignee: GROWN-UP LICENSES LIMITED, Tai Po (HK)

( * ) Notice: Subject to any disclaimer, the term of this patent is extended or adjusted under 35 U.S.C. 154(b) by 331 days.

(21) Appl. No.: 17/584,878

(22) Filed: Jan. 26, 2022

(65) Prior Publication Data

US 2023/0232954 A1 Jul. 27, 2023

(51) Int. Cl.
*A45C 13/38* (2006.01)
*A45C 5/14* (2006.01)
*A45C 13/10* (2006.01)

(52) U.S. Cl.
CPC ..... *A45C 13/385* (2013.01); *A45C 5/14* (2013.01); *A45C 13/10* (2013.01)

(58) Field of Classification Search
CPC ..... A45C 7/0045; A45C 13/1084; A45C 5/03
USPC ..... 292/113, 127, 163, 188
See application file for complete search history.

(56) References Cited

U.S. PATENT DOCUMENTS 1,521,310 A * 12/1924 Moran ..... A45C 7/0045 190/110
6,371,320 B2 * 4/2002 Sagol ..... B25H 3/026 220/4.27
10,442,568 B1 * 10/2019 Summers ..... B65D 55/10
10,603,783 B2 * 3/2020 Brocket ..... B65D 21/02
2002/0030425 A1 * 3/2002 Tiramani ..... B25H 3/023 280/47.35
2006/0027475 A1 * 2/2006 Gleason ..... B25H 3/021 190/110
2007/0194543 A1 8/2007 Duvigneau
2011/0168599 A1 * 7/2011 Koenig ..... B65D 45/20 206/509
2013/0127129 A1 * 5/2013 Bensman ..... B65D 21/0209 206/349
2016/0130034 A1 * 5/2016 Kuhls ..... B65D 21/023 206/510

(Continued)

FOREIGN PATENT DOCUMENTS

KR 102203069 1/2021

*Primary Examiner* — Don M Anderson
*Assistant Examiner* — Justin Caudill
(74) *Attorney, Agent, or Firm* — DUANE MORRIS LLP; Gregory M. Lefkowitz; Randall C. Pyles

(57) ABSTRACT

A wheeled storage box and storage container interlock system includes a hard lid for the storage box and a hard base of the storage container that can be mated and locked together. The lid includes sliding tracks, receiving ports, and a retractable locking component including a buckle to receive and lock to the base when the storage container is stacked onto the storage box. The backside of the base includes tabs and receiving ports. When the base is being stacked on the lid, the tabs on the backside of base can be aligned with receiving ports of the lid and the retractable locking buckle can slide into the receiving ports of the hard bottom. The buckle of the locking component can be used to lock and unlock the lid and the base.

20 Claims, 12 Drawing Sheets

(56) References Cited

U.S. PATENT DOCUMENTS

| | | | | |
|---|---|---|---|---|
| 2016/0168880 | A1* | 6/2016 | Phelan | B65D 55/14 206/1.5 |
| 2017/0166352 | A1* | 6/2017 | Hoppe | B25H 3/022 |
| 2018/0044059 | A1* | 2/2018 | Brunner | B25H 3/02 |
| 2019/0037990 | A1 | 2/2019 | Ayhan | |
| 2019/0039781 | A1* | 2/2019 | Kögel | B65D 21/0212 |
| 2020/0147781 | A1* | 5/2020 | Squiers | A45F 3/047 |
| 2021/0221561 | A1* | 7/2021 | Davidian | B25H 3/02 |
| 2022/0177191 | A1 | 6/2022 | Brunner | |

* cited by examiner

STACK AND LOCK SYSTEM FOR STORAGE PRODUCT AND STORAGE CONTAINER

TECHNICAL FIELD

The present disclosure relates generally to bags and carrier boxes for tools or other items, and more particularly, to an interface and locking system for a storage product and a storage container.

SUMMARY

In an embodiment of the present disclosure, a portable organizer system includes a storage container with a rigid lid and a storage product with a rigid base that is configured to mate with and be locked to the lid. As disclosed, the storage container can be a storage box with wheels and a handle and the storage product can be a storage bag. The disclosed system allows for each of the storage product and the storage container to be used and/or stored individually or together when greater access to items stored is required. When mated and locked together, the disclosed system makes it is more secure and safer to transport the storage product on top of the storage container compared to a situation where the storage product is merely resting on the storage container.

In an embodiment, a system to lock a storage product to a storage container includes a storage container including a lid, the lid including: a lid body; and at least one locking component including: a housing; a spring-loaded locking pin retained by and extending from the housing and configured to fit into a pin receiving portion in a base of a storage product; and a buckle that, when rotated, compresses a spring to retract the spring-loaded locking pin into the housing and out from the pin receiving portion; wherein the base of the storage product includes: a base body including an upper surface and a lower surface; the lower surface includes at least one recess in the base body and the pin receiving portion in the recess to receive the spring-loaded locking pin.

In an embodiment, the at least one locking component is at least two locking components. In an embodiment, the at least two locking components are on opposite sides of the lid. In an embodiment, the at least one locking component is at a front side of the lid. In an embodiment, the at least one locking component includes two spring-loaded locking pins on opposite sides of the housing.

In an embodiment, the buckle is rotatable between an open position and a locked position. In an embodiment, when the buckle in a locked position, the at least one spring-loaded locking pin is biased outward.

An embodiment can further include at least one receiving port in the lid, wherein each receiving port is configured to receive a locating tab in the base.

An embodiment can further include a groove recessed in the lid body configured to receive a mating protrusion in the base.

In an embodiment, the lid is hingedly coupled to the storage container.

In an embodiment, the storage container is a wheeled storage box. In an embodiment, the storage product is a bag.

In an embodiment, a lid of a storage container includes a lid body; at least one locking component including: a housing; and at least one spring-loaded locking pin retained by and extending from the housing and adapted to fit into a pin receiving portion in a base of a storage product; and a buckle that, when rotated to an open position, retracts the spring-loaded locking pin into the housing.

In an embodiment, the lid is generally planar.

An embodiment can further include at least one receiving port, wherein each receiving port is configured to receive a locating tab in a base of a storage product.

An embodiment can further include a groove recessed in the body configured to receive a mating protrusion in a base of a storage product.

In an embodiment, a base of a storage product includes a base body including an upper surface and a lower surface; wherein the lower surface includes at least one recess in the base body and at least one pin receiving portion in a sidewall of the recess.

In an embodiment, the at least one pin receiving portion is two pin receiving portions opposing each other in the at least one recess.

In an embodiment, the at least one recess is two recesses with one each located on opposite sides of the base body from the another of the at least one recess.

In an embodiment, the base can further include a locating tab configured to be received into a receiving port on a lid of a storage container.

The above and other features, elements, characteristics, steps, and advantages of the present invention will become more apparent from the following detailed description of preferred embodiments of the present invention with reference to the attached drawings.

DETAILED DESCRIPTION

The present disclosure describes a system to interlock portable carriers used to carry items such as tools and work pieces. The portable carriers can include a storage box with a rigid lid (see, FIG. 1) and a storage product with a rigid base (see, FIG. 2) that can be stacked on and lockable to the storage box (see, FIG. 3).

Figure 1:
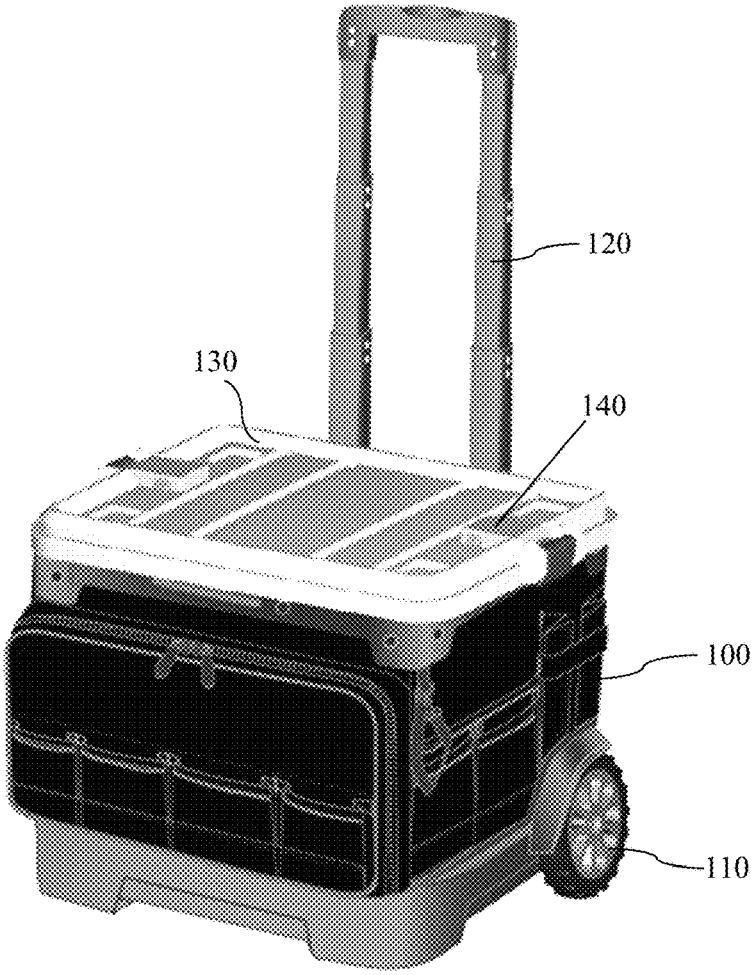
FIG. 1 is a view of a storage container.

As shown in FIG. 1, the storage container 100 can be a box that includes a body with wheels 110 and a handle 120 (e.g., a telescoping handle) used to maneuver the storage container 100. There can be two wheels along a back portion of the body and the handle 120 can be attached to a back wall of the body, so that the storage container 100 can be pulled and rolled by a person using the handle 120 in an extended position as shown in FIG. 1. The body can include a variety of pockets. As shown, the storage box 100 can also include a lid 130 with a locking component 140 attached to the lid 130. The lid 130 can be pivotably attached to the back wall of the body (e.g., via hinges) in order to access a storage volume within the body.

Figure 2:
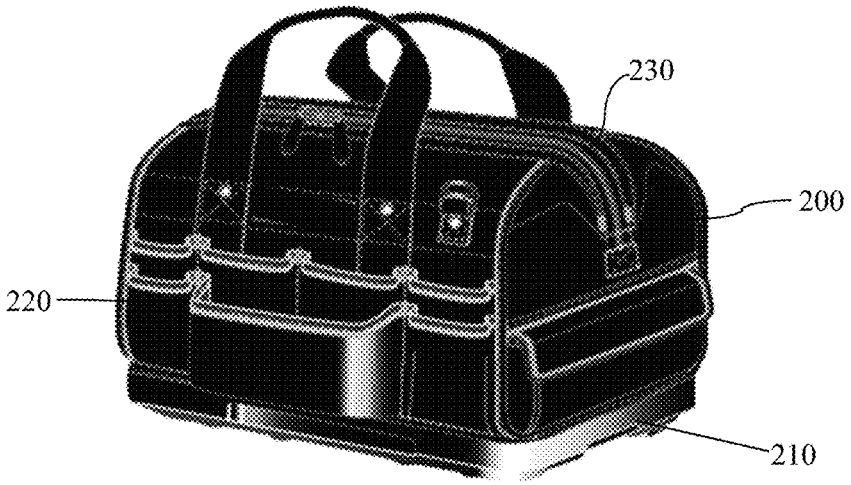
FIG. 2 is a view of a storage product.

As shown in FIG. 2, the storage product 200 can be a fabric bag that includes a body and a base 210. The fabric bag can include pockets 220 on the outside, as well as, a zipper 230 that provides access to a storage volume.

Figure 3:
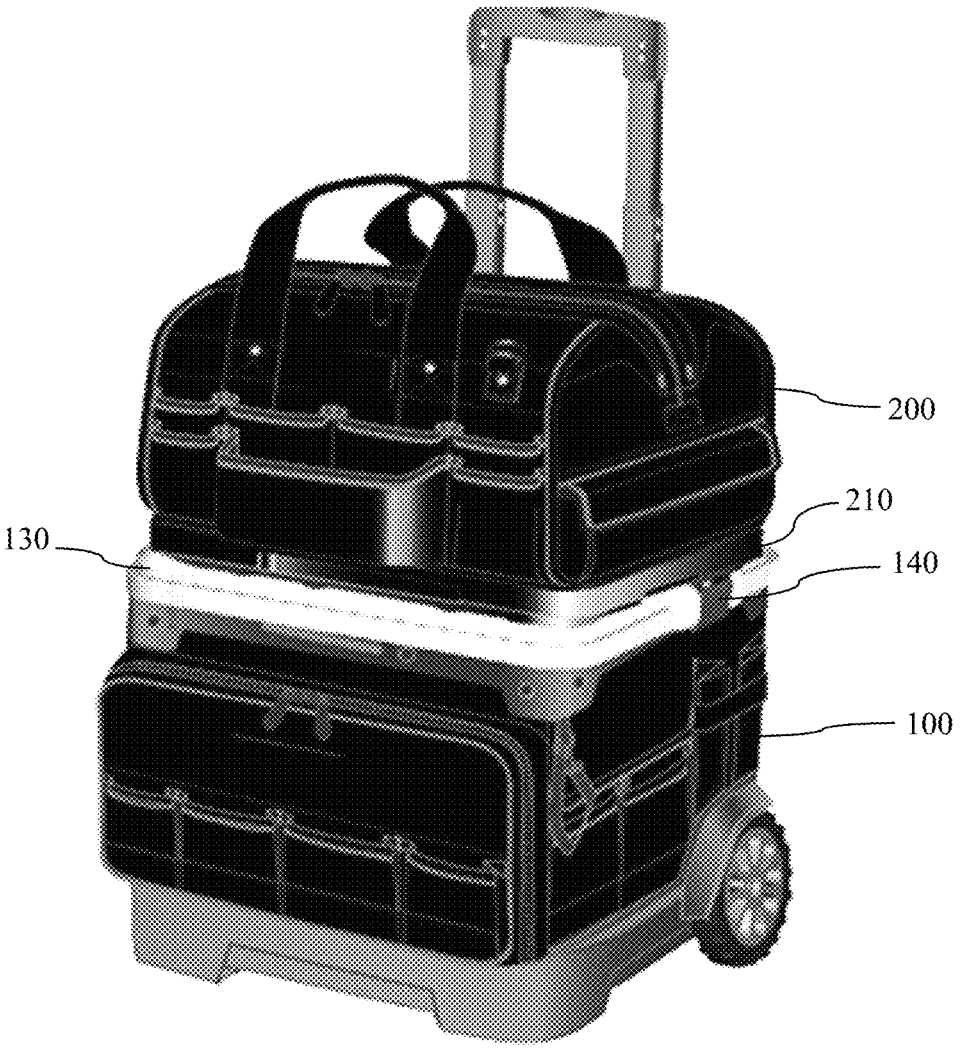
FIG. 3 is a view of the storage product locked to a lid of the storage container.

FIG. 3 shows an embodiment where the storage product 200 is stacked onto the storage container 100 and the lid 130 and the base 210 are locked together via the locking component 140. Locking the storage product 200 to the storage container 100 in this manner provides a secure way to store and transport the storage product 200 and the storage container 100 together to prevent shifting and separation of the two storage containers.

Figure 4:
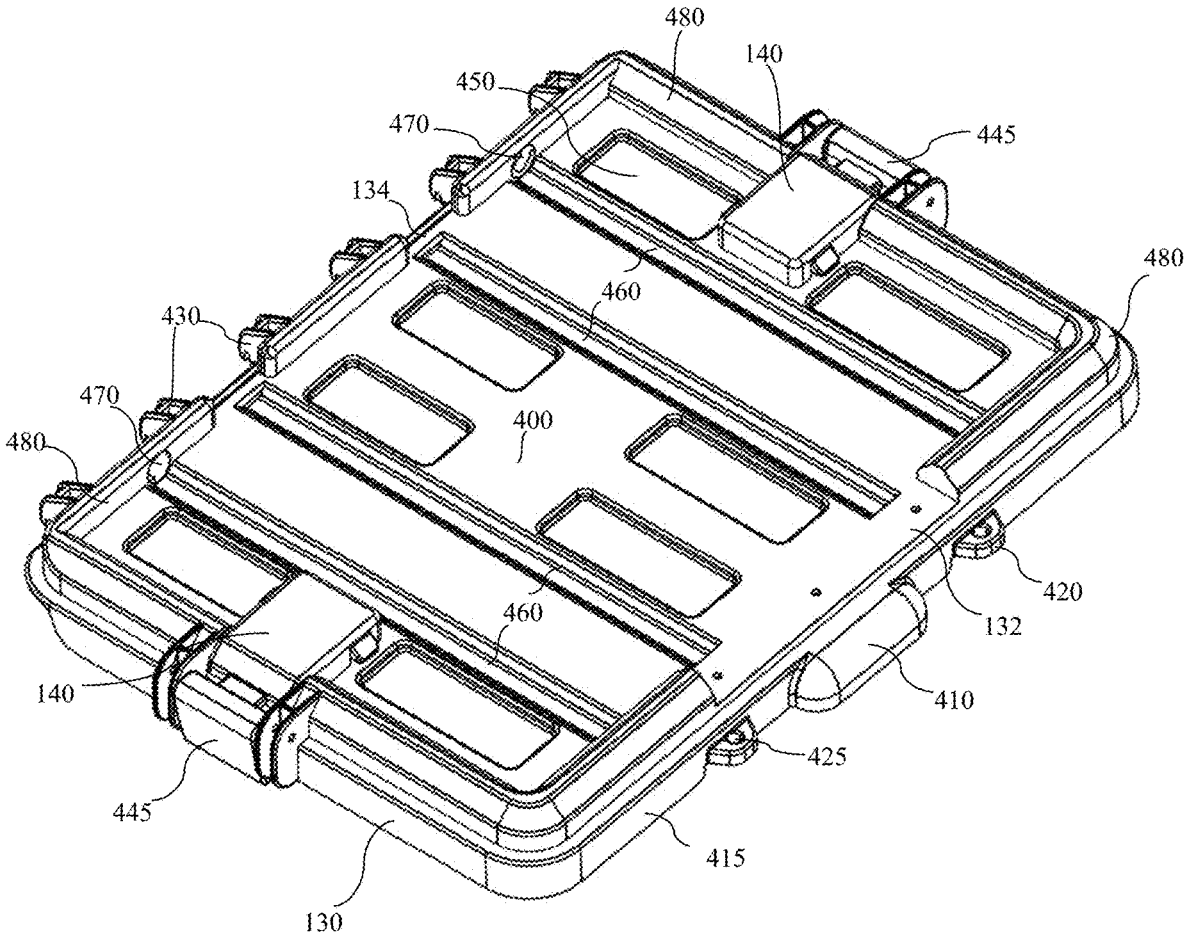
FIG. 4 is a view of a lid of a storage container according to an embodiment of the disclosed invention.
Figure 5:
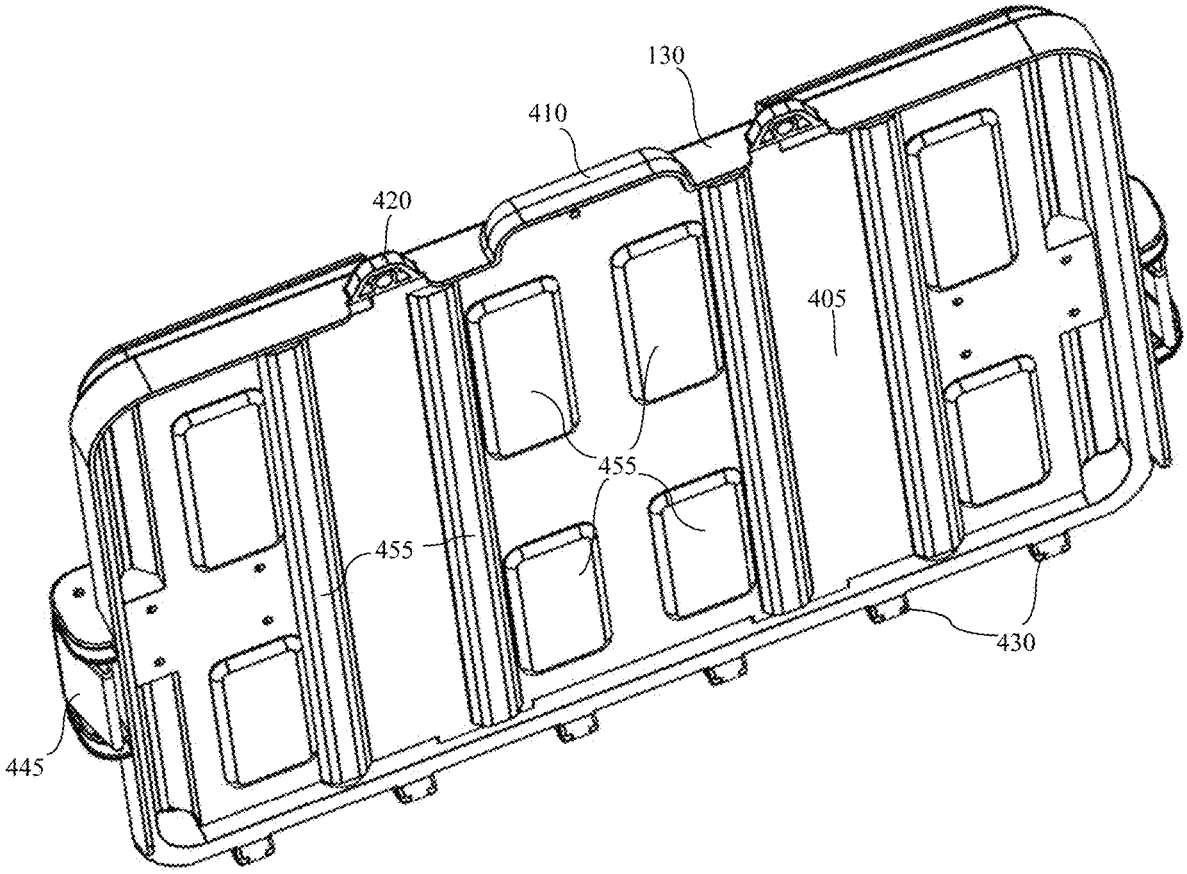
FIG. 5 is a view of a lid of a storage container according to an embodiment of the disclosed invention.
Figure 6:
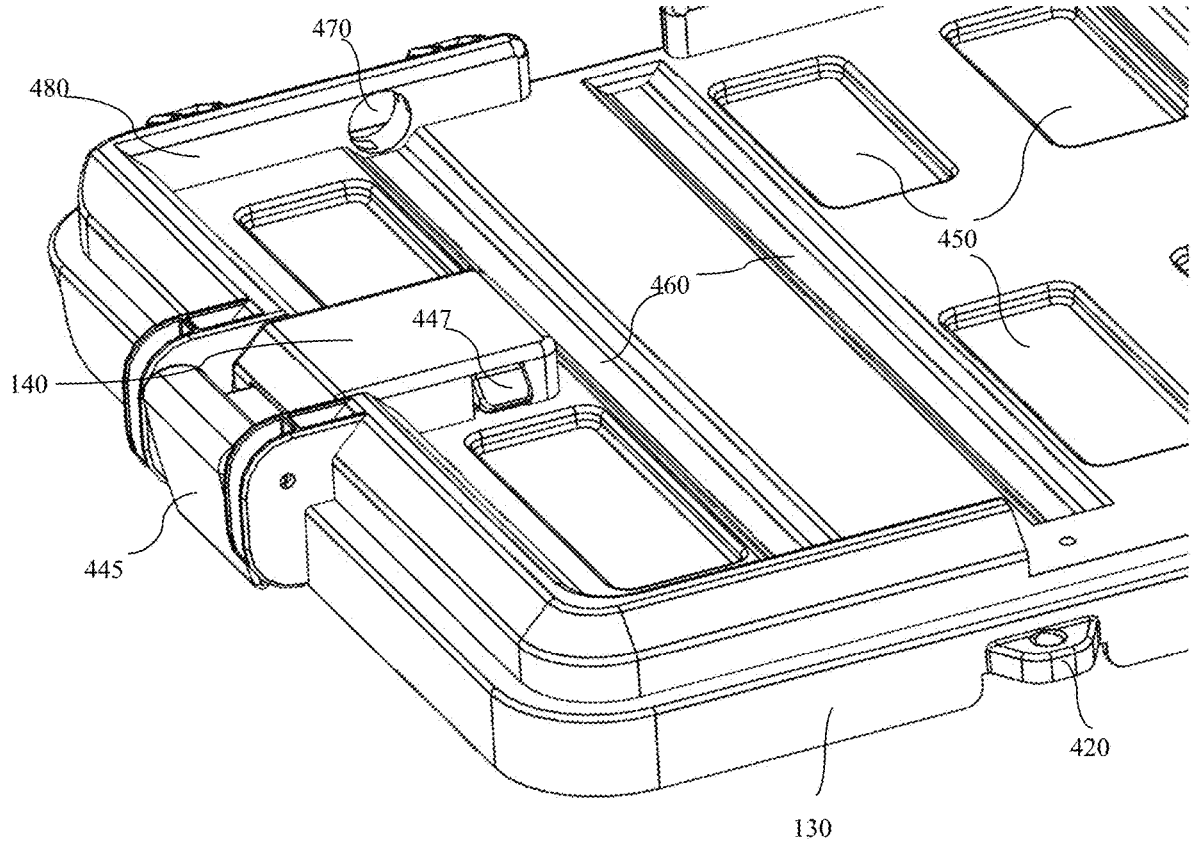
FIG. 6 is a view of a lid of a storage container according to an embodiment of the disclosed invention.

FIGS. 4-6 are different views of the lid 130 according to an embodiment of the disclosed invention. FIG. 4 shows a top perspective view of the lid 130. FIG. 5 shows a bottom perspective view of the lid 130. FIG. 6 a closer view of a top portion of the lid 130, including more detail of the locking mechanism 140.

As shown in FIGS. 4 and 5, the lid 130 has a generally planar shape in that it is much longer and wider than thick. As shown, the length and width of the lid 130 can define a generally rectangular shape. Other suitable shapes of the lid 130 are possible. The lid 130 and remaining portions of the storage container 100 to which the lid 130 is attached must be sturdy enough to support the weight of the storage product filled with tool and/or work pieces (or other items, such as food, beverages, ice, etc.) and/or another product stacked on top of the lid 130. The lid 130 can be made from plastic and injection molded to define the structural features. The lid 130 can be molded from a polymer, plastic, composite, or any other suitable material, although it should be understood that other self-supporting materials (e.g., metals, fabrics, etc.) are possible.

As shown in FIG. 4, the top surface 400 of the lid 130 can include a grip 410 protruding from one side of the lid 130 in which a user can grab with their fingers to open and close the lid 130. The lid 130 can also include a locking feature 420 used to lock the lid 130 to the body of the storage container 100 or to the base 210 of the storage product 200. As shown, the locking feature 420 can protrude from an edge 415 of the lid 130 and include a through hole 425. When the lid 130 is closed, the through hole 425 can be aligned with a corresponding through hole in a portion of the storage container 100 or storage product in which to pass a shackle of a padlock through. On a side opposite to the grip 410, the lid 130 can include hinge tangs 430 used to define a hinge with portions of the storage container 100.

As also shown in FIG. 4, the lid 130 can include the locking component 140 mounted to a top surface 400 of the lid 130. FIG. 4 shows that the lid 130 can include two locking components 140, with one each mounted on shorter sides opposing each other of the rectangular lid 130. Optionally, the locking component 140 can be arranged in any suitable location on the lid 130. As shown, the locking component 140 can include a buckle 445 used to operate the locking component 140 to unlock the base 210 from the lid 130.

The view of FIG. 4 also shows that the lid 130 can include a recess 450 or series of recesses 450 with a surface below the top surface 400 of the lid 130. The recesses 450 can be located to accommodate any protrusion that protrudes from a bottom of the base 210 such as feet, as will be described below. As shown, the recesses 450 are rectangularly shaped, but can be any suitable shape that does not interfere with protrusions from the base. The recesses 450 can be used to help locate and orient the base 210 with respect to the lid 130. Optionally, at least some recesses 450 can be circular and sized to fit a drink can or bottle or impart structural integrity.

The view of FIG. 4 also shows that the lid 130 can include a groove 460 or series of grooves 460 with a surface below the top surface of the lid 130. The grooves 460 can extend laterally (e.g., in a straight line) from a front 132 of the lid 130 to a back 134 of the lid 130. The grooves 460 can be located to accommodate mating protrusions 760 that protrude from the bottom of the base 210, as will be described below. While joining the base to the lid 130, the mating protrusions 760 on the base 210 can slide in the grooves 460 toward a back 134 of the lid 130. The lid 130 can include a receiving port 470 configured to receive a locating tab 770 from the base, when the mating protrusions 760 slide in the grooves 460 to the back 134 of the lid 130. The receiving port 470 can be located in a lip 480 that is defined around a rear peripheral portion of the lid 130. As shown, the receiving port 470 can be a cutout or through hole through the lip 480 and sized to fit the locating tab 770 on the base 210. Alternatively, the receiving port 470 can be a recess in the lip 480 or any suitable shape to fit the locating tab 770 on the base 210. The lip 480 can be protruding up from a top surface 400 of the lid 130 along a back portion of the lid 130, and can optionally be provided around the entire periphery of the lid 130. The lip 480 can be defined to fit outside of sides of the base 210 and used to help locate and retain the base 210 to the lid 130.

FIG. 5 is a view of the bottom or inside surface 405 of the lid 130. FIG. 5 shows an alternate view of the grip 410, the hinge tangs 430, and the buckle 445. FIG. 5 also shows protrusions 455 that correspond to the recesses 450 and the grooves 460 that are visible from the top side.

FIG. 6 is a closer view of a portion of the lid 130. FIG. 6 shows a more detailed view of the locking feature 420, the locking component 140, the buckle 445, the recesses 450, the grooves, 460, the receiving port 470, and the lip 480. FIG. 6 also provides a closer view of a locking pin 447 that is a part of the locking component 140, which is described in more detail below.

Figure 7:
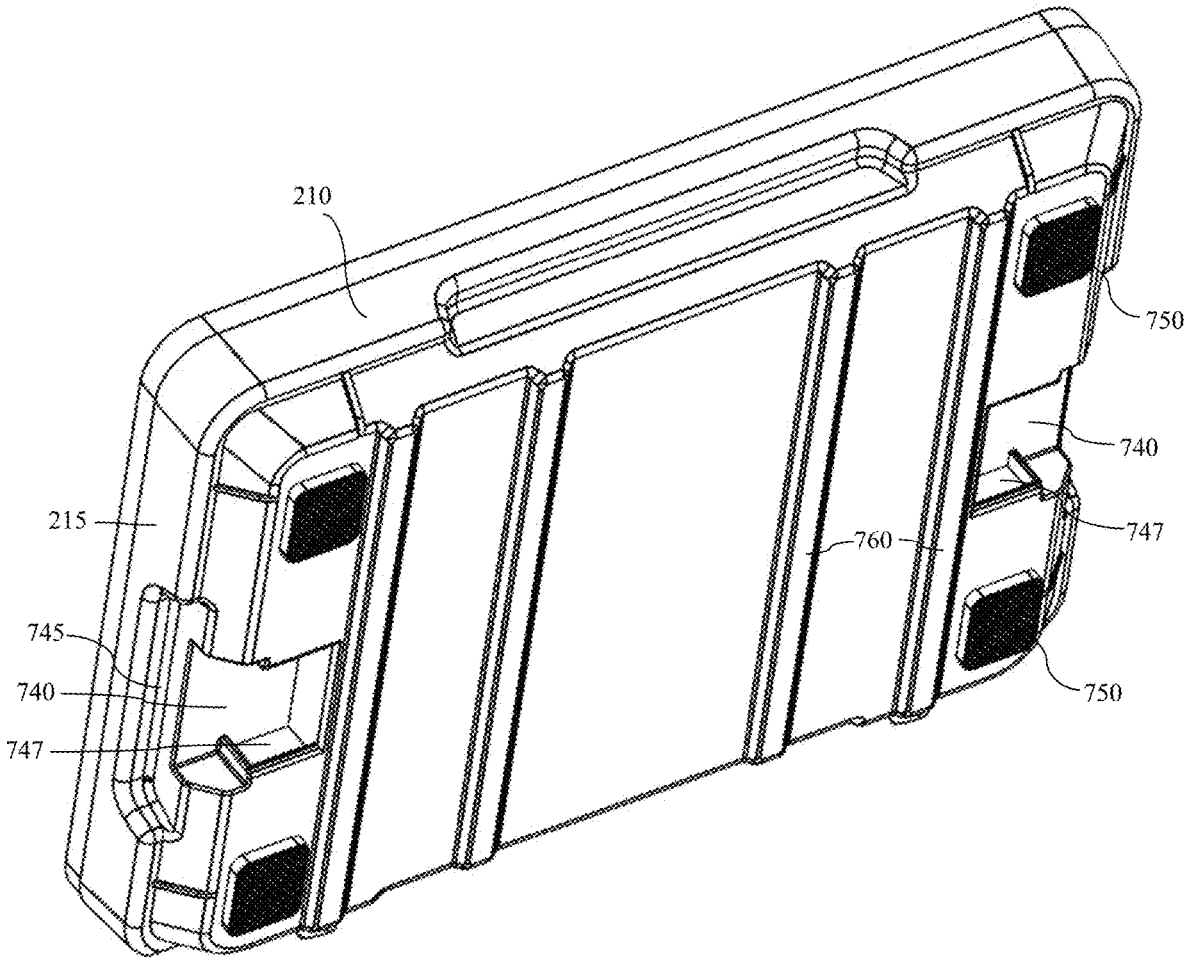
FIG. 7 is a view of a base of a storage product according to an embodiment of the disclosed invention.
Figure 8:
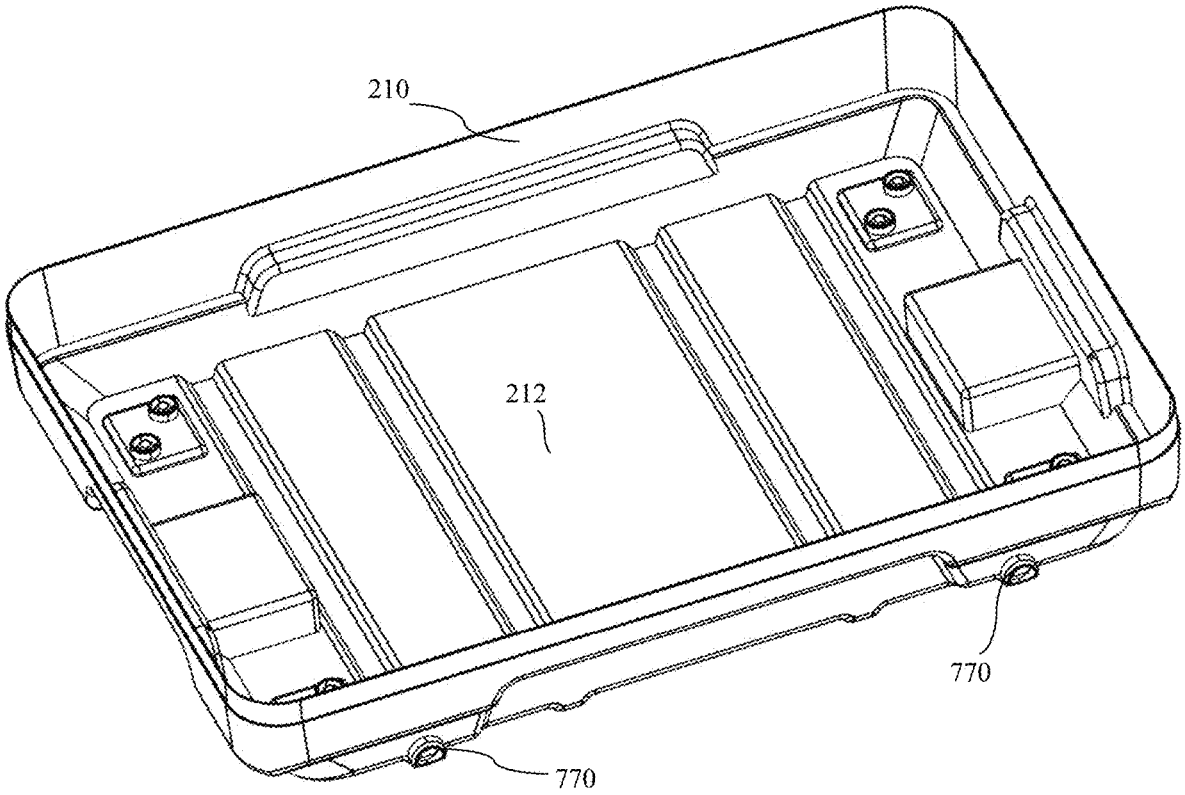
FIG. 8 is a view of a base of a storage product according to an embodiment of the disclosed invention.
Figure 9:
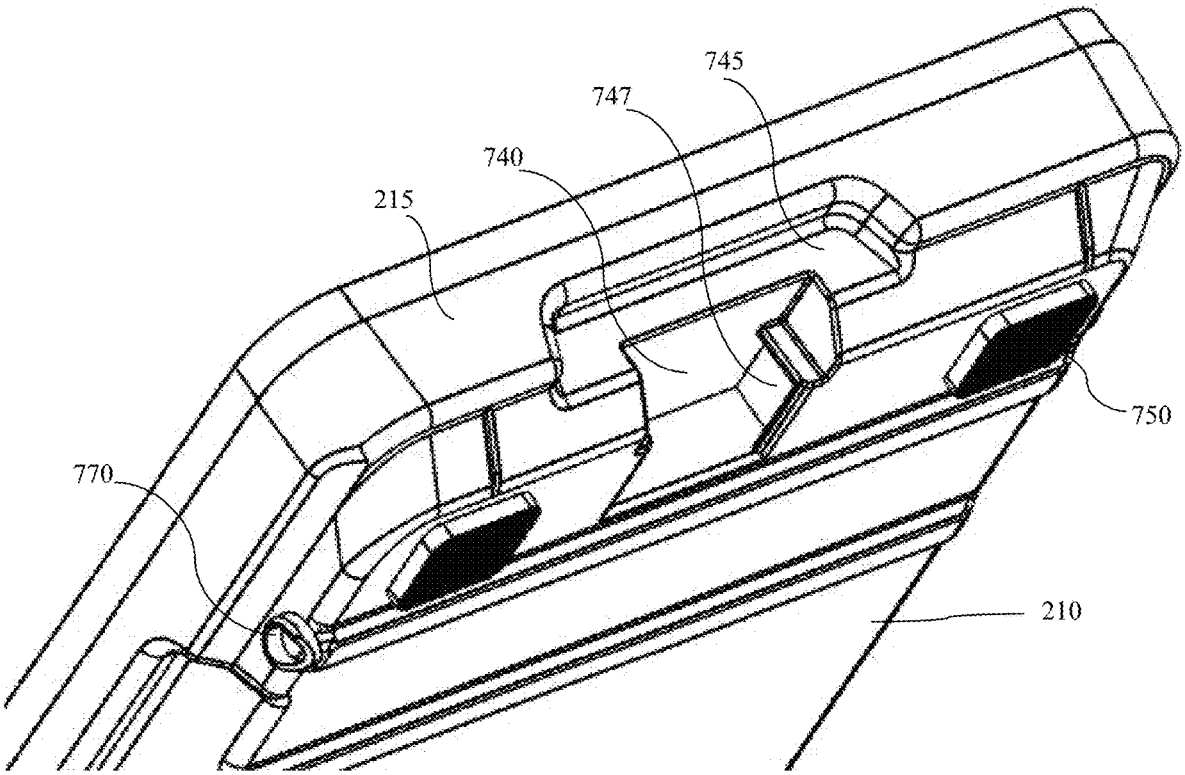
FIG. 9 is a view of a base of a storage product according to an embodiment of the disclosed invention.

FIGS. 7-9 are views of a base 210 of a storage product 200 according to an embodiment of the current disclosure. As shown in FIGS. 7 and 8, the base 210 can have a generally planar shape in that it is much longer and wider than thick. As shown, the length and width of the base 210 can define a generally rectangular shape. FIG. 7 is a bottom perspective view showing features of the base 210 that complement and interact with features of the lid 130 when the storage product 200 is rested on and locked to the lid 130. FIG. 7 shows that the base 210 can include a connection recess 740 that is configured to fit over the locking component 140 in the lid 130 when the base 210 is placed on the lid 130. FIG. 7 shows that the base 210 can include a buckle recess 745 that is provided so that the base 210 does not interfere with the range of motion of the buckle 445 and buckle mounting features when the base 210 is on the lid 130.

Each connection recess 740 can include a pin receiving portion 747 that is configured to fit over a locking pin 447 of the locking component 140 in the lid 130 when the base 210 is placed on the lid 130. As shown, the pin receiving portion 747 can include structural features such as sides, protrusions, and/or lips used, especially along the lower edge, to define the pin receiving portion 747 such that the locking pin 447 is secured into the pin receiving portion 747 when the buckle 445 is in the lockable configuration. FIG. 7 shows that the base 210 can include two connection recesses 740, with one located on the opposite sides of the rectangular base 210 where each of the connection recesses 740 includes two opposing pin receiving portions 747. The connection recesses 740 can be on the sides 215 of the base 210.

FIG. 7 shows that the base 210 can include features to promote self-supporting of the storage product to which it is attached, such as feet 750 to contact a surface below the storage product (e.g., the ground, a work bench, a table, etc.). The feet 750 can be attached to the base 210 as separate components or integrally formed as a portion of the base 210. As shown, the feet 750 can protrude downward from the bottom surface of the base 210 and can be configured to fit into recesses 450 in the lid 130 when a storage product is placed or locked onto the lid 130 of a storage container 100. FIG. 7 also shows that the base 210 can include long and narrow protrusions 760 that protrude from the bottom surface of the base 210 and are configured to fit into the corresponding long and narrow recesses 460 in the lid 130 to assist a user in aligning the base 210 and the lid 130 when placing or locking the storage product 200 to the storage container 100.

The base 210 can be molded from a polymer, plastic, composite, or any other suitable material, although it should be understood that other self-supporting materials (e.g., metals, fabrics, etc.) are possible.

FIG. 8 is a top-rear perspective view showing an inside of the base 210. FIG. 8 shows that the inside of the base 210 is generally defined having a bowled shape with a recessed bottom portion 212 and a lip 780 or sides extending away from the bottom portion 212. It should be noted that the interior of the base 210 is not visible in the fully assembled storage product 200, as shown in FIGS. 2 & 3. FIG. 8 also shows that the base 210 can include a locating tab 770. As shown, the locating tab 770 can be a protrusion that extends from a rear side of the base 210 and is sized to fit into a receiving port 470 on the lid. The locating tab 770 can rounded or any other suitable shape to fit into the receiving port on the lid. FIG. 8 shows that the base 210 can include two locating tabs 770 but the base 210 can include any suitable number of locating tabs 770, with the lid 130 including corresponding receiving ports 470.

FIG. 9 is a closer view of a portion of the base 210. FIG. 9 shows an alternate view of the connection recess 740, the buckle recess 745, a pin receiving portion 747, feet 750, and a locating tab 770.

Figure 10:
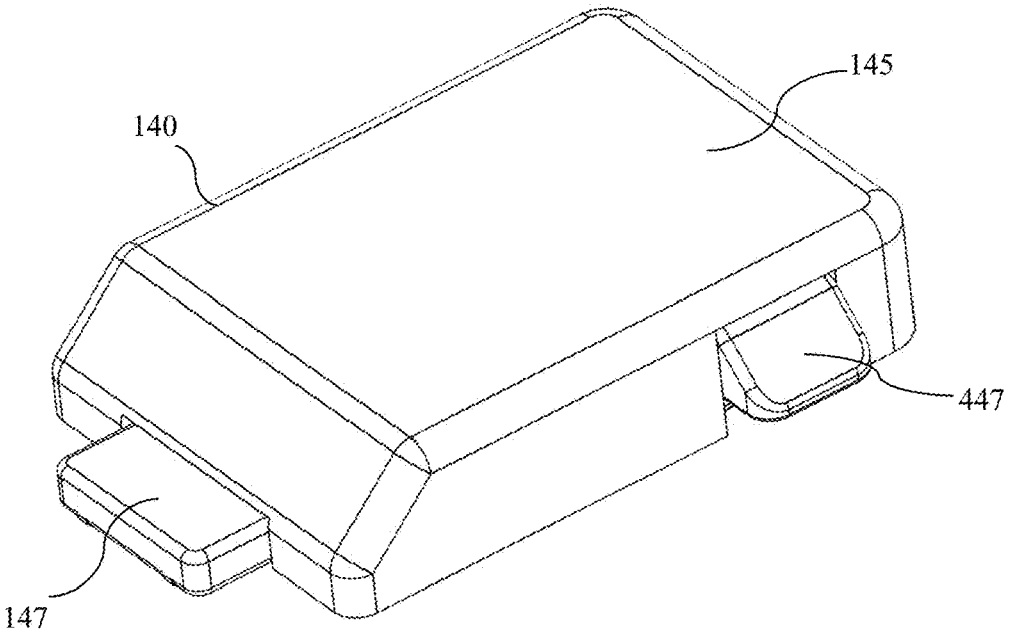
FIG. 10 is a view of a locking component according to an embodiment of the disclosed invention.
Figure 11:
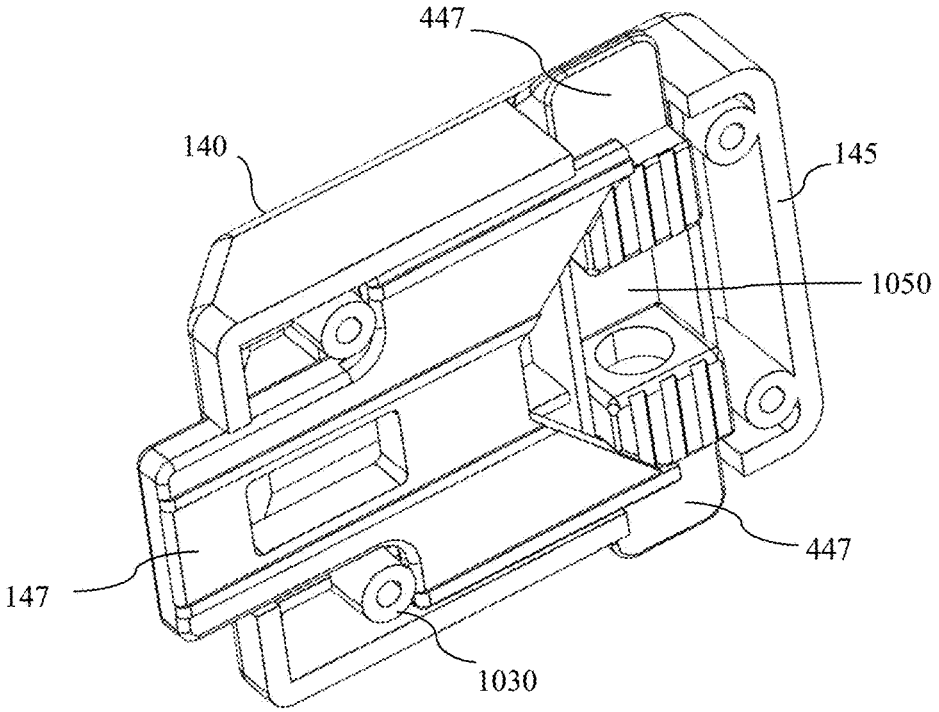
FIG. 11 is a view of a locking component according to an embodiment of the disclosed invention.

FIGS. 10 and 11 are detailed views of a locking component 140 that can be attached to a lid 130 according to an embodiment of the present disclosure. FIG. 10 is a top perspective view of the locking component 140. FIG. 11 is a bottom perspective view of the locking component 140, when it is not attached to the lid 130 to better show the moving components of the locking component 140. FIGS. 10 and 11 show that the locking component 140 can include a generally cubic shaped housing 145 that is configured to house and retain an unlock tab 147 on one side of the housing 145 and a locking pin 447 on another side of the housing 145. As shown in FIG. 11, the connection component 140 can include two locking pins 447 on opposing sides of the housing 145.

FIG. 11 also shows that the housing 145 can include features used to mount the locking component 140 to the lid 130. For example, the housing 145 can include a boss 1030 that includes a bore to receive a fastener such as a screw passed through a hole from the inside of the lid 130. Optionally, the locking component 140 can be bonded or adhered to the lid 130 or attached to the lid 130 using any suitable mechanism.

As shown, a portion of the unlock tab 147 can protrude from one side of the housing 145 and be configured to be pushed into the housing 145 and against the locking pins 447. Additionally, the locking component 140 can include a space 1050 between two locking pins 447 used to locate a spring (not shown). The spring can be provided into the space 1050 under compression to force the two locking pins 447 outward from the housing 145 and away from each other. When mounted to the lid 130, rotation of the buckle 445 can force the unlock tab 147 laterally toward the locking pins 447, thereby applying pressure to force the two locking pins 447 inward toward each other to further compress the spring. The buckle 445 can force the unlock tab 147 far enough such that the two locking pins 447 are retracted into the housing 145 enough that ends for the two locking pins 447 clear the pin receiving portions 747 of the base 210 so that the storage product 200 can be unlocked and separated from the lid 130 of the storage container 100.

Figure 12:
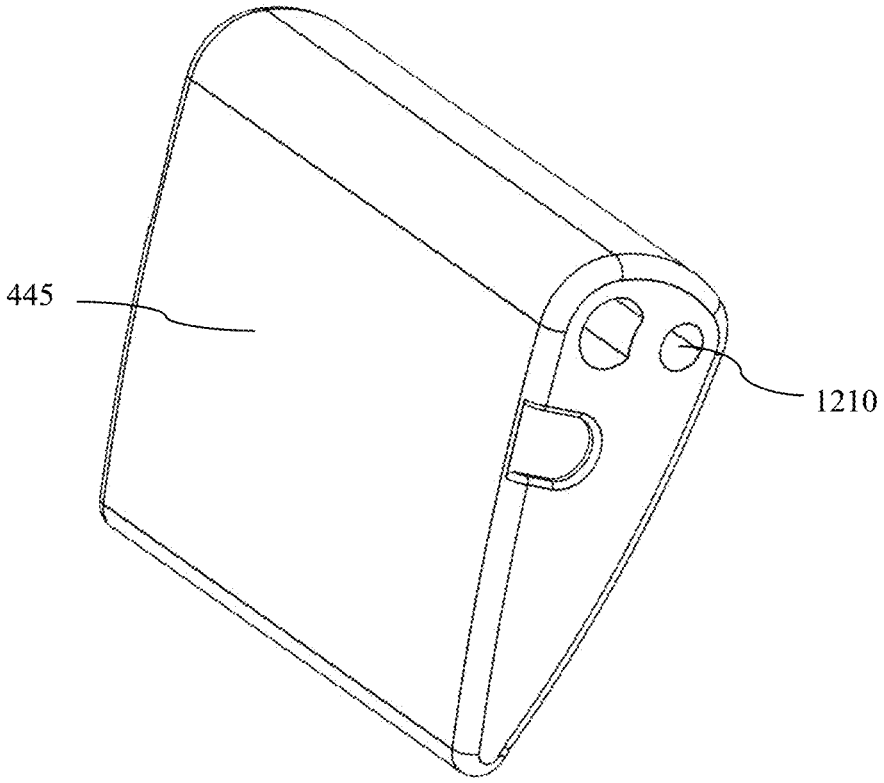
FIG. 12 is a view of a buckle according to an embodiment of the disclosed invention.
Figure 13:
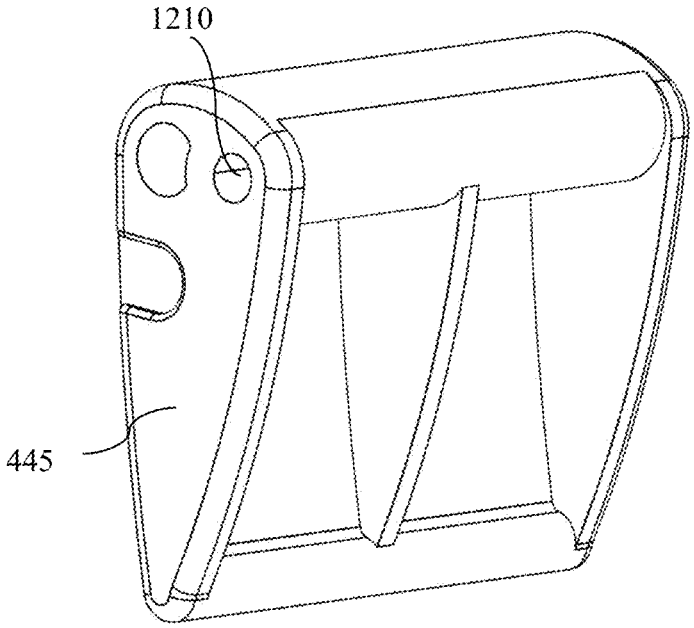
FIG. 13 is a view of a buckle according to an embodiment of the disclosed invention.

FIGS. 12 and 13 are views of the buckle 445 that can be attached to the lid 130 according to an embodiment of the present disclosure. As shown, the buckle 445 can be generally shaped like a fin or an airfoil where one end is thinner than an opposing end. As shown, the buckle 445 can include a transverse hole 1210 extending entirely though the buckle 445. This hole 1210 can be used to attach the buckle 445 to the lid 130 by using a hinge pin that is positioned through the hole 1210 with ends of the hinge pin attached to mounting features on the lid 130. In such a configuration, the hinge pin allows the buckle 445 to rotate about a longitudinal axis of the hinge pin and hole 1210. The buckle 445 can be molded from a polymer, plastic, composite, or any other suitable material, although it should be understood that other self-supporting materials (e.g., metals, fabrics, etc.) are possible.

When mounted to the lid 130, the thicker end of the buckle 445 can act like a cam when rotating about the longitudinal axis. As such, in the lockable or down position, as shown in FIGS. 4-6, the buckle 445 can be general oriented to be parallel to a side of the lid 130 and the storage container 100. Optionally, the buckle 445 can include features to lock the lid 130 to the storage container 100 while in the down position. When rotated upward about the longitudinal axis, the thicker end of the buckle 445 forces the unlock tab 147 to retract the locking pins 447 inward, as described above.

The buckle 445 can be molded from a polymer, plastic, composite, or any other suitable material, although it should be understood that other self-supporting materials (e.g., metals, fabrics, etc.) are possible.

Figure 14A:
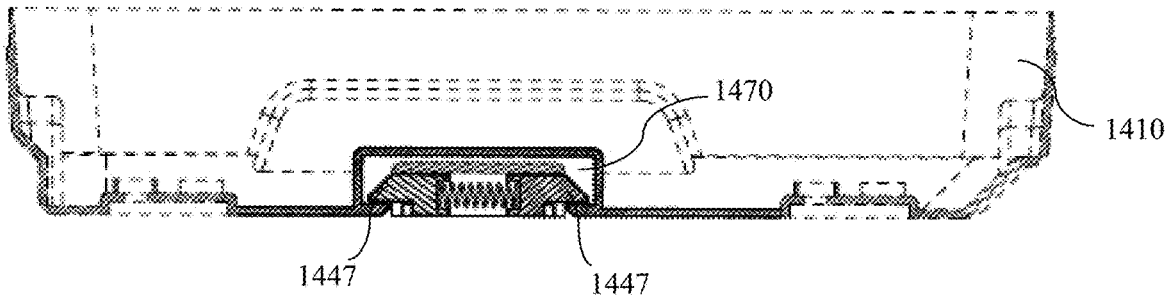
FIG. 14A, FIG. 14B, and FIG. 14C graphically depict the operation of stacking and locking a storage product to a storage container according to an embodiment of the disclosed invention.
Figure 14B:
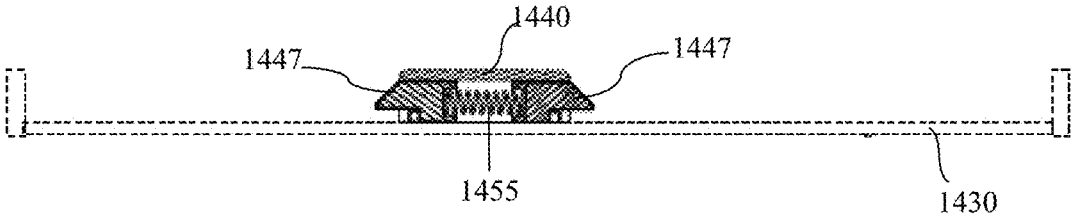
Figure 14C:
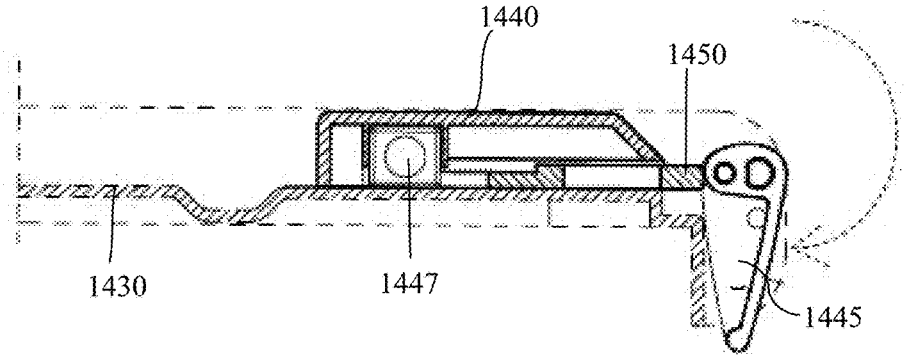

FIGS. 14A-14C graphically depicts the operation of stacking and locking a storage product to a storage container according to an embodiment of the disclosed invention. FIG. 14B represents a sectional view of a locking component 1440 mounted on a lid 1430. FIG. 14A represents a sectional view of a base 1410 mated with the lid 1430 where the locking component 1440 is in a connection recess 1470 in the base 1410. FIG. 14C represents a side sectional view of the locking component 1440 in a lockable position with a buckle 1445 in a down position.

As previously mentioned, the connection recess 1470 can include a pin receiving portion that can include lower lips. As shown, the locking component 1440 can include a helical spring 1455 that forces two opposing locking pins 1447 away from each other. The outer edges of the locking pins 1447 can include a flat or straight portion and a tapered portion that is angled with respect to the straight portion. As such, when the base 1410 is properly aligned and forced toward the lid 1430, the lower lips of the connection recess 1470 push against the tapered portion of the corresponding locking pins 1447 to force the locking pins 1447 to further compress the spring 1455 and retract until the locking pins 1447 clear the lips. At that point, the locking pins 1447 will forced by the spring 1455 to extend outward into the locked position within the connection recess 1470 as shown in FIG. 14A. In this position, the straight portion of the locking pins 1447 with respect to the lips lock the locking component 1440 and lid 1430 to the base 1410 such that that the storage product (not shown) cannot be separated from the storage container (not shown) without releasing the buckle 1445, as shown and described with respect to FIGS. 15A-15C.

FIG. 14C shows that the unlock tab 1450 of the locking component 1440 is extended while the buckle 1445 is in the down position. Thus, the locking pins 1447 are also forced to be extended by the spring 1455 and able to lock within the connection recess 1470.

Figure 15A:
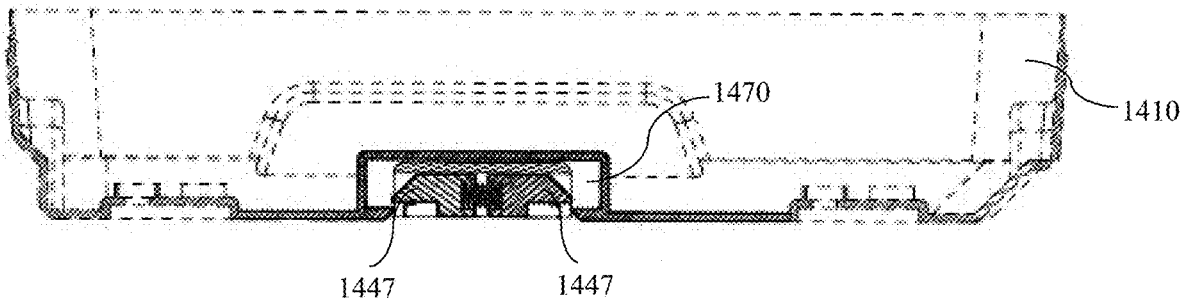
FIG. 15A, FIG. 15B, and FIG. 15C graphically depict the operation of unstacking and unlocking a storage product from a storage container according to an embodiment of the disclosed invention.
Figure 15B:
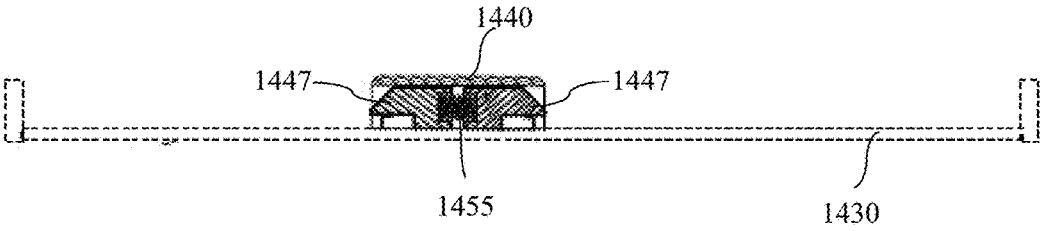
Figure 15C:
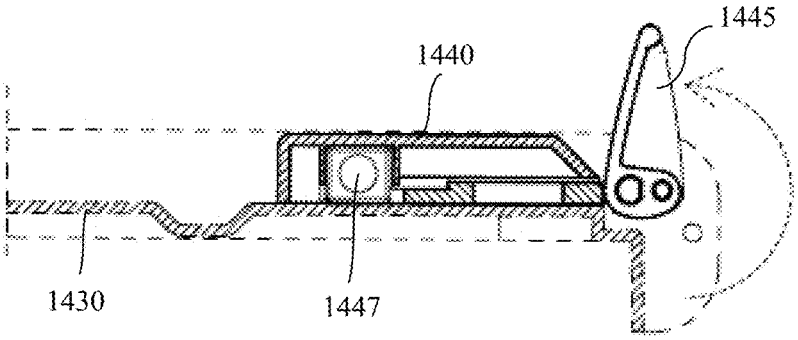

FIGS. 15A-15C graphically depicts the operation of unstacking and unlocking a storage product from a storage container according to an embodiment of the disclosed invention. FIG. 15B represents a sectional view of the locking component 1440 mounted on the lid 1430. FIG. 15A represents a sectional view of the base 1410 mated with the lid 1430 where the locking component 1440 is in the connection recess 1470 in the base 1410. FIG. 15C represents a side sectional view of the locking component 1440 in an unlockable position with the buckle 1445 in an up position.

As shown in FIG. 15C, the buckle 1445 is up and in the unlock position where it forces the unlock tab 1450 far enough into the locking component 1440 to compress the spring 1455 and draw the two locking pins 1447 together such that the two locking pins 1447 are retracted enough that ends of the two locking pins 1447 can clear the pin receiving portions in the connection recess 1470 of the base 1410 (as seen in FIG. 15A) so that the base 1410 of the storage product (not shown) can be unlocked and separated from the lid 1430 of the storage container (not shown).

Although embodiments have been described in terms of exemplary features, they are not limited thereto. Rather, the appended claims should be construed broadly, to include other variants and embodiments, which may be made by those skilled in the art without departing from the scope and range of equivalents.

What is claimed is:

1. A system to lock a storage product to a storage container, the system comprising:
a storage container including a lid, the lid including:
a lid body; and
at least one locking component including:
a housing;
a spring-loaded locking pin retained by and extending from the housing and configured to fit into a pin receiving portion in a base of a storage product; and
a buckle that, when rotated, compresses a spring to retract the spring-loaded locking pin into the housing and out from the pin receiving portion; wherein
the base of the storage product includes:
a base body including an upper surface and a lower surface;
the lower surface includes at least one recess in the base body and the pin receiving portion in the recess to receive the spring-loaded locking pin.

2. The system of claim 1, wherein the at least one locking component is at least two locking components.

3. The system of claim 2, wherein the at least two locking components are on opposite sides of the lid.

4. The system of claim 1, wherein the at least one locking component is at a front side of the lid.

5. The system of claim 1, wherein the buckle is rotatable between an open position and a locked position.

6. The system of claim 1, wherein the at least one locking component includes two spring-loaded locking pins on opposite sides of the housing.

7. The system of claim 1, wherein when the buckle in a locked position, the at least one spring-loaded locking pin is biased outward.

8. The system of claim 1, further comprising at least one receiving port in the lid, wherein each receiving port is configured to receive a locating tab in the base.

9. The system of claim 8, further comprising a groove recessed in the lid body configured to receive a mating protrusion in the base.

10. The system of claim 1, wherein the lid is hingedly coupled to the storage container.

11. The system of claim 1, wherein the storage container is a wheeled storage box.

12. The system of claim 1, wherein the storage product is a bag.

13. A lid of a storage container, comprising:
a lid body;
at least one locking component including:
a housing; and
at least one spring-loaded locking pin retained by and extending from the housing and adapted to fit into a pin receiving portion in a base of a storage product; and
a buckle that, when rotated to an open position, retracts the spring-loaded locking pin into the housing.

14. The lid of claim 13, wherein the lid is generally planar.

15. The lid of claim 13, further comprising at least one receiving port, wherein each receiving port is configured to receive a locating tab in a base of a storage product.

16. The lid of claim 13, further comprising a groove recessed in the body configured to receive a mating protrusion in a base of a storage product.

17. A base of a storage product, comprising:
a base body including an upper surface and a lower surface; wherein
the lower surface includes a first recess and a second recess,
the first recess is located proximate a first end of the base body and the second recess is located proximate a second end of the base body laterally opposite the first end,
the first recess includes at least one first recess pin receiving portion in that includes a first recess lip protruding from a sidewall of the first recess and extending laterally outward from an endwall of the first recess, and the second recess includes at least one second recess pin receiving portion that includes a second recess lip protruding from a sidewall of the second recess and extending laterally outward from an endwall of the second recess.

18. The base of claim 17, wherein the at least one first recess pin receiving portion is two pin receiving portions opposing each other in the first recess, and the at least one second recess pin receiving portion is two pin receiving portions opposing each other in the second recess.

19. The base of claim 17, further comprising a locating tab configured to be received into a receiving port on a lid of a storage container.

20. The base of claim 17, wherein the at least one first recess pin receiving portion and the at least one second recess pin receiving portion are configured to be secured with a corresponding locking pin in a lid in the condition that a corresponding buckle of the lid is in a lockable configuration.

* * * * *